US007931339B1

(12) United States Patent
Stocker et al.

(10) Patent No.: US 7,931,339 B1
(45) Date of Patent: Apr. 26, 2011

(54) SEAT ASSEMBLY

(76) Inventors: Jennifer R Stocker, Louisville, KY (US); Douglas Stocker, Louisville, KY (US)

( * ) Notice: Subject to any disclaimer, the term of this patent is extended or adjusted under 35 U.S.C. 154(b) by 200 days.

(21) Appl. No.: 12/174,717

(22) Filed: Jul. 17, 2008

(51) Int. Cl.
*B60N 2/02* (2006.01)

(52) U.S. Cl. ..... 297/383; 297/328; 297/440.15; 297/451.3

(58) Field of Classification Search ..... 297/215.15, 297/313, 325, 326, 327, 328, 383, DIG. 10, 297/215.12, 440.15, 440.16, 467
See application file for complete search history.

(56) References Cited

U.S. PATENT DOCUMENTS

| | | | | | |
|---|---|---|---|---|---|
| 839,976 | A | * | 1/1907 | Yale | 297/383 |
| 1,465,291 | A | * | 8/1923 | Walker | 297/150 |
| 1,564,339 | A | * | 12/1925 | Fraser et al. | 33/515 |
| 1,685,770 | A | * | 10/1928 | Bowen | 297/326 |
| 1,922,418 | A | * | 8/1933 | Conant | 297/357 |
| 2,255,464 | A | * | 9/1941 | Hall, Jr. | 2/44 |
| 3,218,102 | A | * | 11/1965 | Specketer | 297/330 |
| 3,250,569 | A | | 5/1966 | Gaffney | |
| 4,030,750 | A | * | 6/1977 | Abram | 297/375 |
| 4,097,087 | A | * | 6/1978 | Garavaglia | 297/284.7 |
| 4,466,660 | A | * | 8/1984 | Mabie | 297/215.11 |
| 4,552,404 | A | * | 11/1985 | Congleton | 297/330 |
| 4,650,249 | A | * | 3/1987 | Serber | 297/313 |
| 4,712,833 | A | | 12/1987 | Swanson | |
| 4,786,105 | A | * | 11/1988 | Sheehan et al. | 297/271.6 |
| 4,876,755 | A | * | 10/1989 | Parrish | 297/284.3 |
| 4,889,387 | A | * | 12/1989 | Gregory | 297/452.27 |
| 5,082,327 | A | | 1/1992 | Crisp | |
| 5,295,728 | A | * | 3/1994 | Schaevitz | 297/195.1 |
| 5,333,931 | A | | 8/1994 | Weddendorf | |
| 5,375,910 | A | | 12/1994 | Murphy | |
| 5,462,333 | A | | 10/1995 | Beauvais | |
| 5,542,746 | A | * | 8/1996 | Bujaryn | 297/423.12 |
| 5,599,066 | A | * | 2/1997 | Chih | 297/383 |
| 5,678,892 | A | * | 10/1997 | Heitlinger | 297/344.18 |
| 5,915,787 | A | | 6/1999 | Brookman | |
| 5,988,738 | A | * | 11/1999 | Blessing et al. | 297/141 |
| 5,988,747 | A | | 11/1999 | Jeans | |
| 6,619,745 | B2 | * | 9/2003 | Roberts et al. | 297/383 |
| 6,619,747 | B2 | * | 9/2003 | Ko et al. | 297/423.12 |
| 6,637,818 | B2 | | 10/2003 | Williams | |
| 6,702,383 | B2 | | 3/2004 | Newman et al. | |
| 6,739,661 | B1 | | 5/2004 | Dukes | |
| 6,983,991 | B2 | | 1/2006 | Strona | |
| 2002/0135219 | A1 | | 9/2002 | Rogers | |
| 2005/0200180 | A1 | | 9/2005 | Guyton et al. | |
| 2007/0072880 | A1 | | 3/2007 | Guzi et al. | |

* cited by examiner

*Primary Examiner* — David Dunn
*Assistant Examiner* — David E Allred
(74) *Attorney, Agent, or Firm* — James E. Cole; Middleton Reutlinger

(57) ABSTRACT

A seat assembly for improving posture of a user comprises a substantially firm seat portion angled downwardly from rear to front, a back support extending upwardly in a rear area of the seat portion, a pad positioned on the back support and, the back support positionable at least two locations for varying seat depth.

28 Claims, 10 Drawing Sheets

SEAT ASSEMBLY

CROSS-REFERENCE TO RELATED APPLICATION

None

TECHNICAL FIELD

The present invention relates generally to a seating assembly and more specifically to a seating assembly which promotes proper alignment of the hips, spine, and shoulders in order to increase attention, productivity, and comfort.

BACKGROUND

It is known that pelvic or hip abduction is an important condition for proper posture and stability. Hip abduction induces anterior pelvic rotation providing a wider base for more stable support of the upper body. Hip abduction also operates to bring the pelvis into vertical alignment with the spinal column.

The scapula (shoulder blade) is also a contributor to function of upper extremities. As with the alignment of the pelvis with the spine, alignment of the scapula with the upper arm bone and glenohumeral joint is necessary to perform mobile and coordinated tasks efficiently. Stabilization of the scapula requires highly coordinated and symmetric contractions of unrestricted muscles. High and/or wide seat backs restrict the range of the scapula, and may contribute to increase an upper thoracic rounding. This is commonly seen with people having rounded upper back and shoulder posture. Another result of high or wide seat backs may be seen in those having a head forward posture, with scapula abduction and shoulder internal rotation.

Current chairs having flat or bucketed seating surfaces facilitate posterior tilting of the pelvis, and thereby causing flattening of the natural anterior convex curvature of the lumbar spine. This promotes an overall flex position of the entire spine and possible cervical hyperextension. As a result, in order to move into an upright position to alleviate tension on the skeletal system, the person sitting in the seat must activate fast twitch fibers to move into an upright position. However, as fatigue sets in the skeletal system returns to the poor posture position. Additionally, many chairs are not adjustable for the torso and/or popliteal height. With chairs which are either too tall or too short of popliteal height, the deterioration of pelvic and spinal alignment typically occurs. This decreases the use of active movement against the surface, and decreases activation of the proprioceptive system which ultimately impacts attention levels, arousal, motor learning, head orientation and posture control. Further, chair depths, measured from knee to hip, are also too short for tall users.

The alignment of hip and spine along with the inhibition of posterior hip rotation has many advantages. For example, some studies indicate a direct correlation between productivity and posture/positioning. Moreover, ergonomic studies indicate that proper posture while in a seated position decreases back pain.

It would be desirable to create a seat assembly which overcomes these deficiencies.

SUMMARY

A seat assembly for improving posture of a user comprises a seat portion angled downwardly from rear to front, a back support extending upwardly in a rear area of the seat portion, a pad positioned on the back support and, the back support positionable at least two locations for varying seat depth. The assembly wherein the seat portion is adjustable through a plurality of angles wherein the seat portion is declined. The assembly further comprising a base, the seat portion pivotally connected to the base. The assembly further comprising an angle adjustment structure. The assembly the angle adjustment structure being movable through a plurality of positions on the base. The assembly wherein the back support is a rod extending through the seat portion. The assembly wherein the seat portion further comprises a plurality of adjustment apertures, the rod being adjustable through the plurality of adjustment apertures. The assembly further comprising a base having at least one leg. The assembly the seat portion positioned on the base. The assembly wherein the back support extends upwardly from the base above a rear edge of the seat portion. The seat assembly wherein the base has an adjustable popliteal height. The seat assembly wherein an adjustable portion of the base is at an angle of about 107 degrees from said seat portion. The seat assembly wherein the back support is at an angle of between about 105-110 degrees from the seat portion. The seat assembly wherein the back support is adjustable through a vertical distance. The seat assembly wherein the seat portion has a rigid seat surface.

A posture improving seat assembly comprises a declined seat portion having an upper rear edge and a lower front edge, a base portion, the declined seat portion connected to and supported by the base portion, a back support adjustable to move the position of the back support relative to the lower front edge and said upper rear edge and, the back support being vertically adjustable relative to the seat portion. The seat assembly, the back support having a width which fits between a user's shoulder blades. The seat assembly wherein the back support further comprises a foam padding. The seat assembly further comprising a hinge connecting the seat portion to the base. The seat assembly further comprising at least one adjustment structure within the declined seat portion. The seat assembly wherein the at least one adjustment structure is at least one aperture. The seat assembly further comprising an adjustable structure in the base portion. The seat assembly wherein the base portion comprises first and second legs each having an upper leg portion and a lower leg portion.

BRIEF DESCRIPTION OF THE ILLUSTRATIONS

In order that the invention may be better understood, embodiments of the seat assembly in accordance with the present invention will now be described by way of examples. These embodiments are not to limit the scope of the present invention as other embodiments of the seat assembly of the present invention will become apparent to one having ordinary skill in the art upon reading the instant description. Examples of the present invention are shown in figures wherein.

Figure 5:
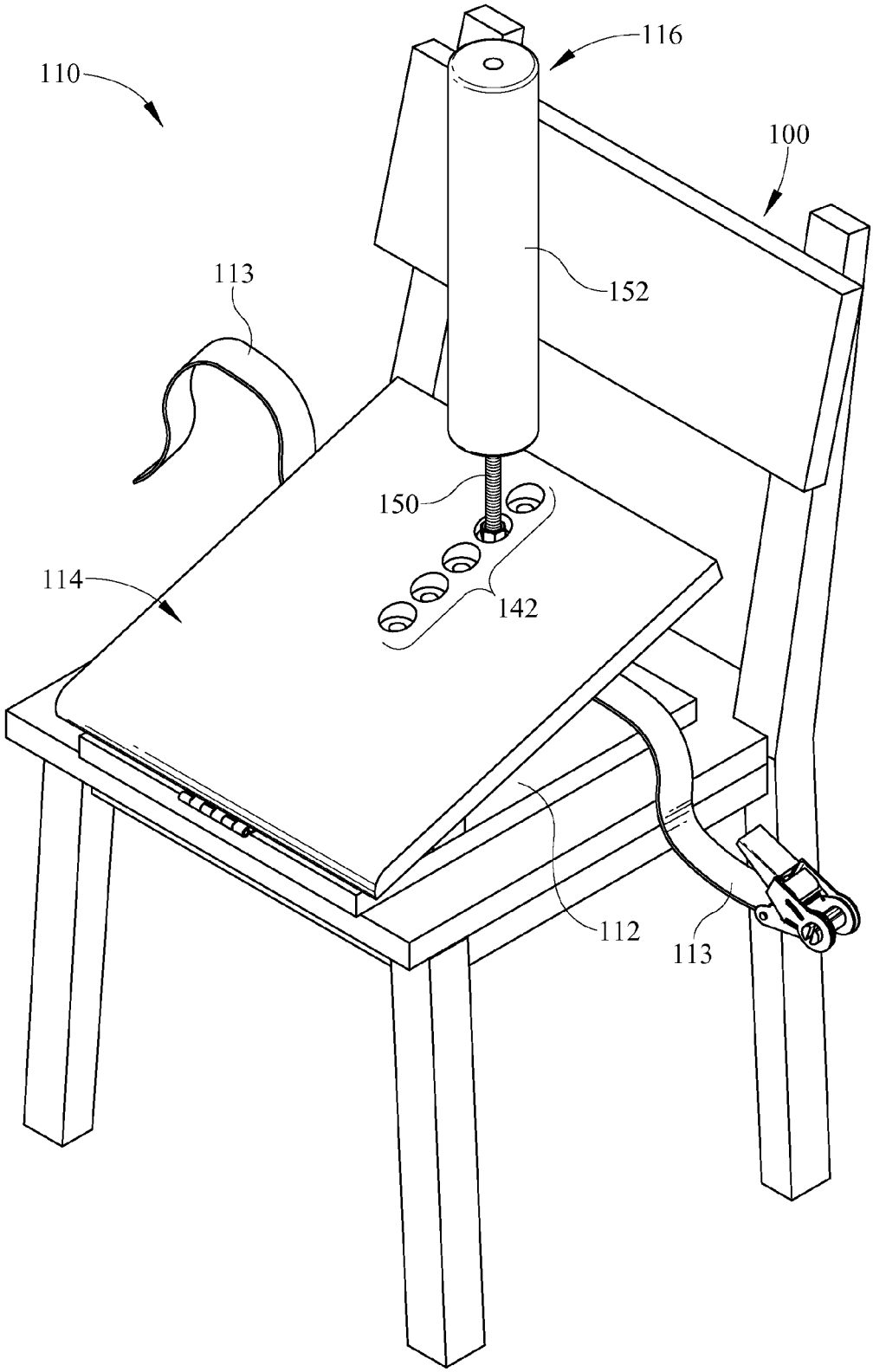
Figure 6:
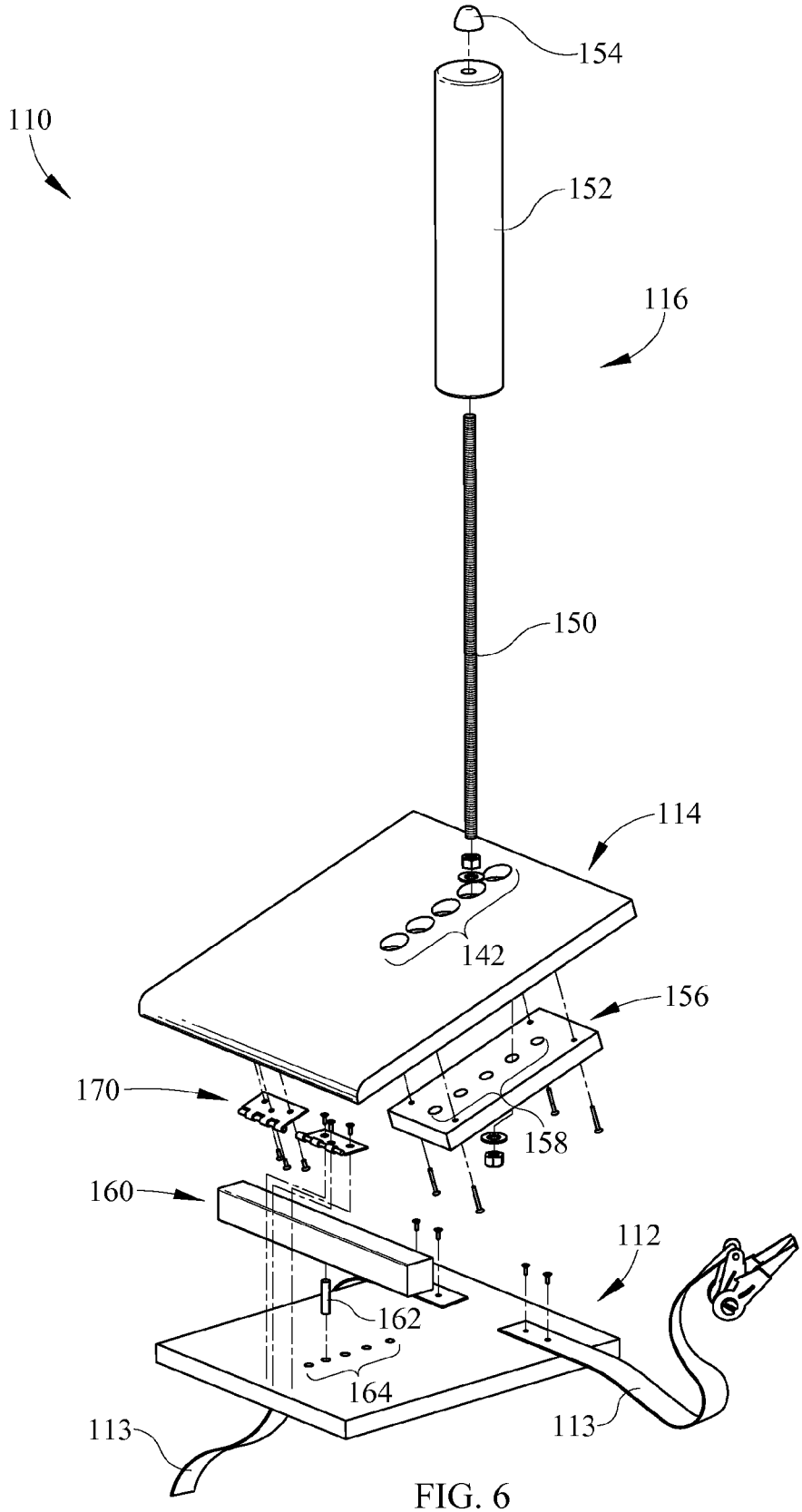
Figure 7:
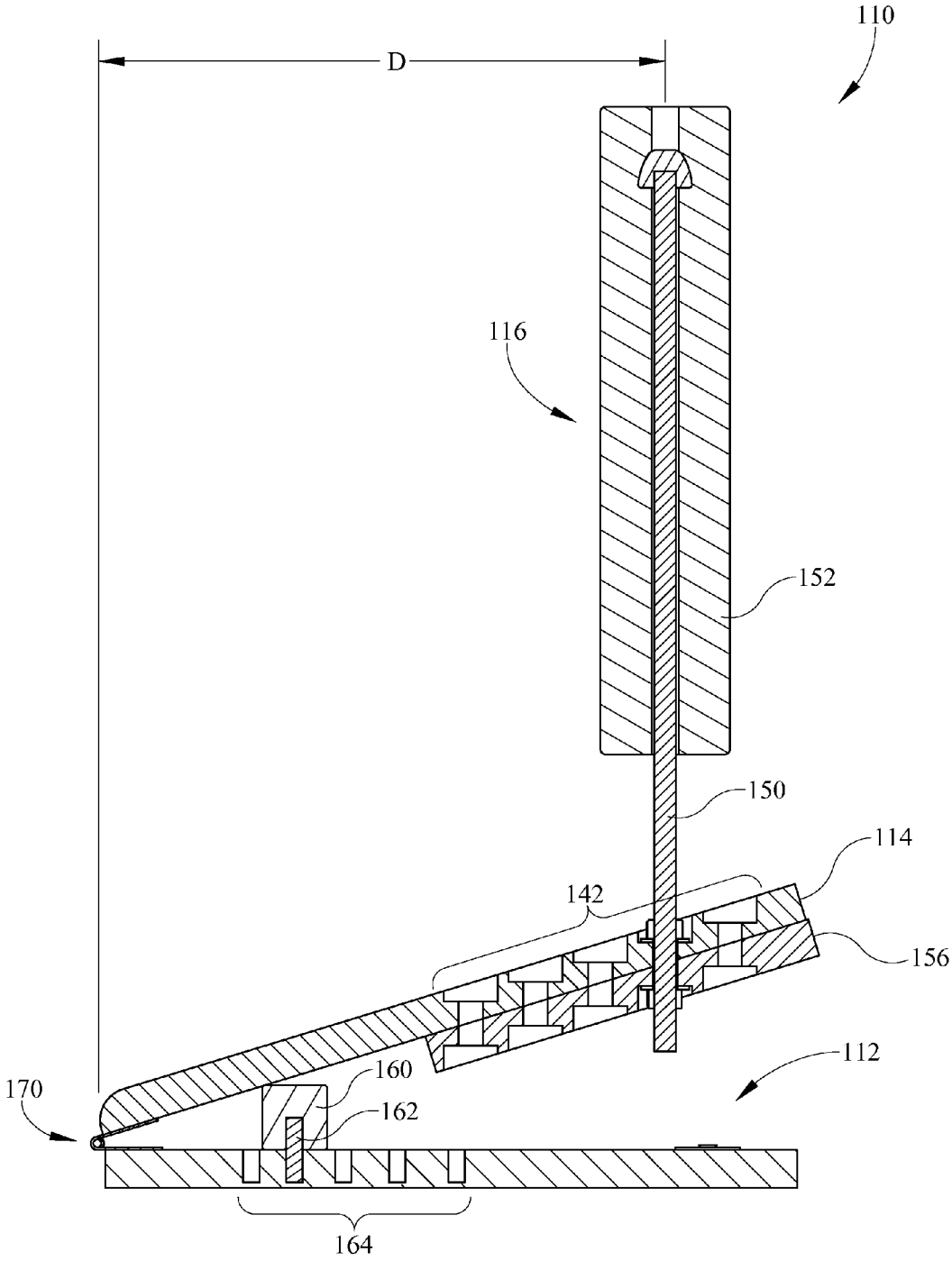
Figure 8:
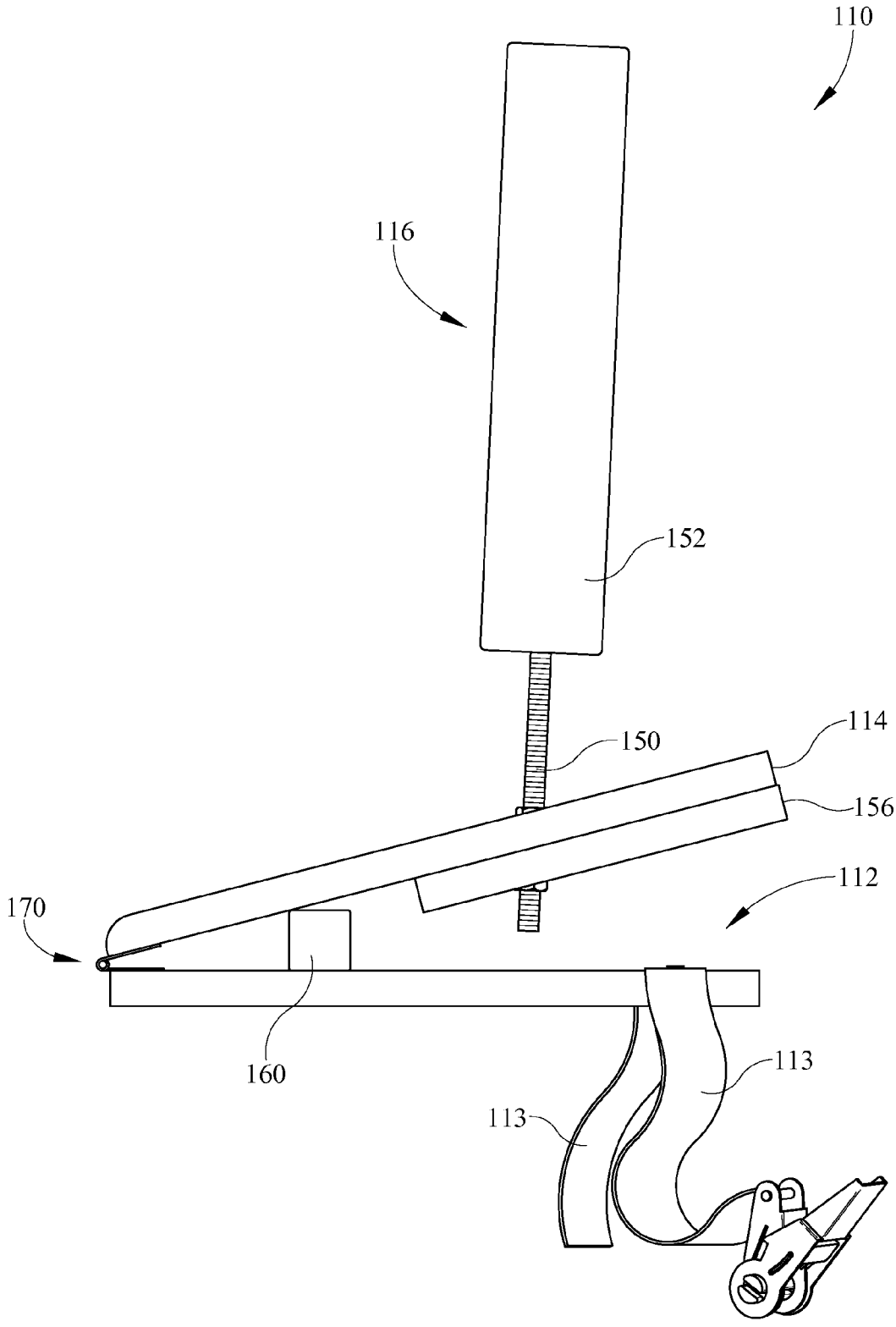
Figure 9:
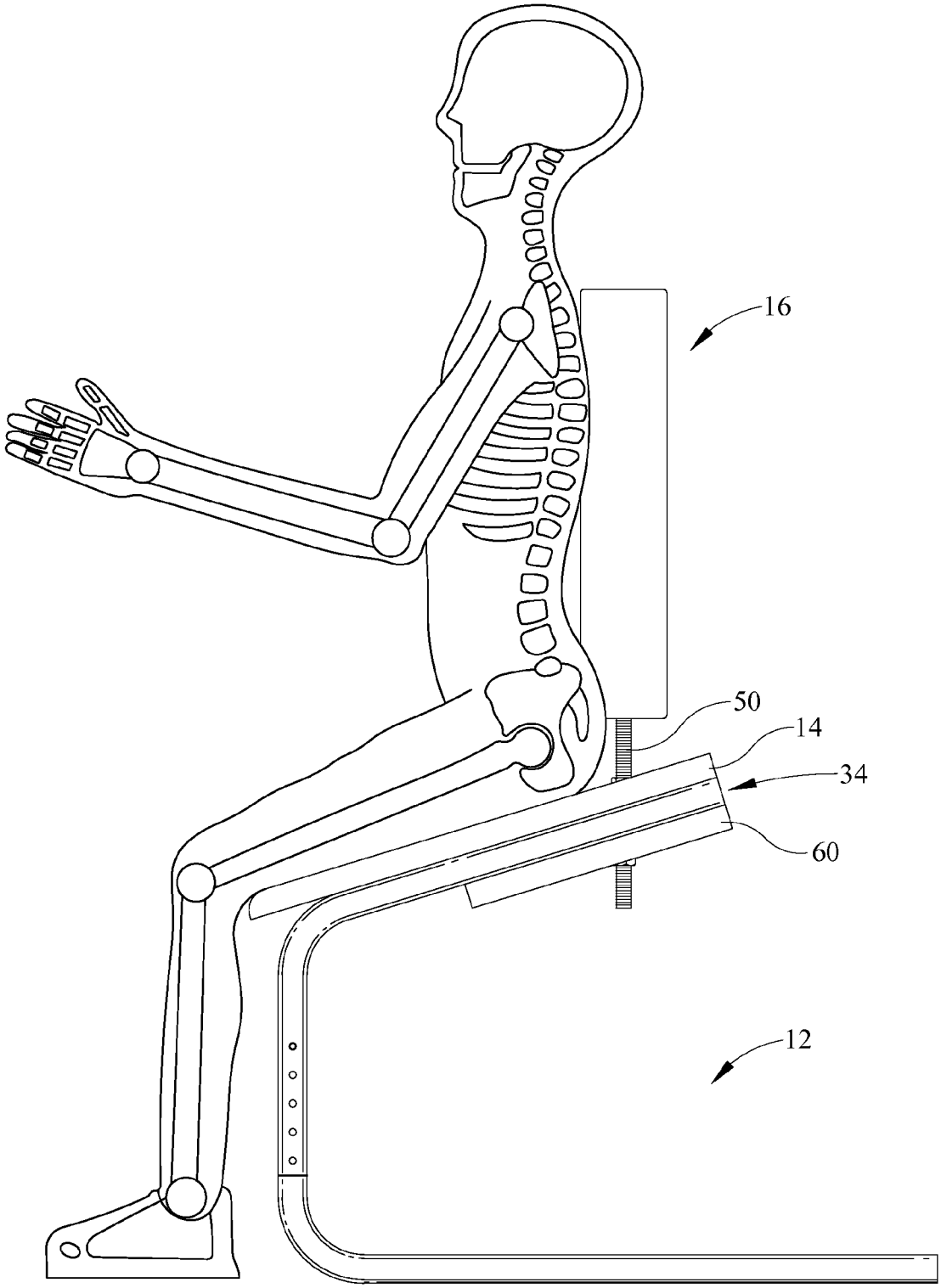
Figure 10:
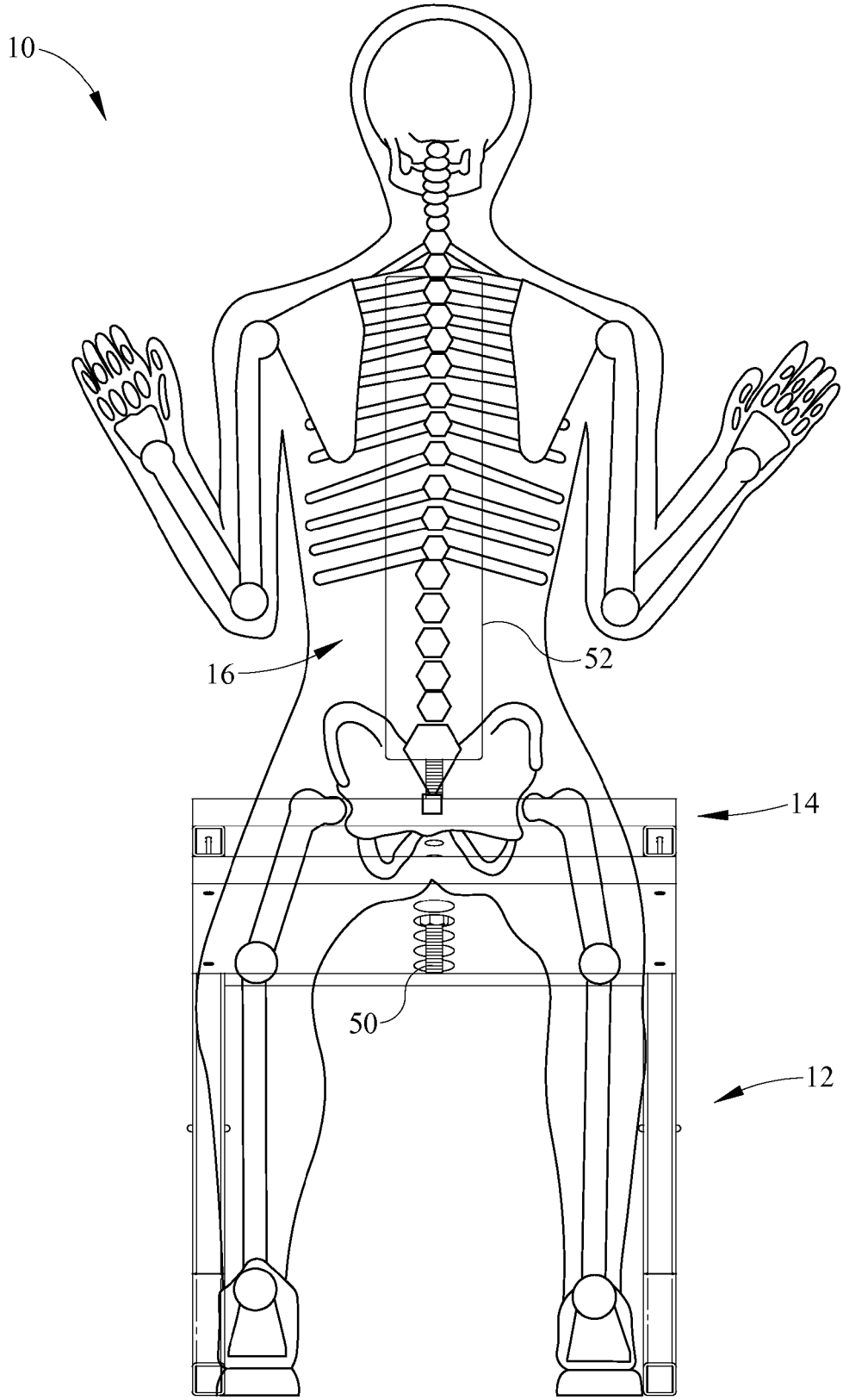

FIG. 5 perspective view of a second embodiment of a seat assembly;

FIG. 6 is an exploded perspective view of the seat assembly of FIG. 5;

FIG. 7 is a cross-sectional view of the seat assembly of FIG. 5;

FIG. 8 is a side view of the seat assembly of FIG. 5;

FIG. 9 is a side view with anatomical depiction of a person seated in the seat assembly; and, FIG. 10 is a rear view of the depiction of FIG. 5.

DETAILED DESCRIPTION

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The seat assemblies of the present embodiment activate postural muscle groups to maintain proper posture while also prompting scapula to move away from the abducted position. The seat assembly provides a seat having a hard declined surface, which allows for activation of muscle tissue which promotes proper posture for a user and a back support which is disposed between a user's shoulder blades, in order to provide a thoracic prompt and cause the scapula to move to a proper postural position.

Figure 1:
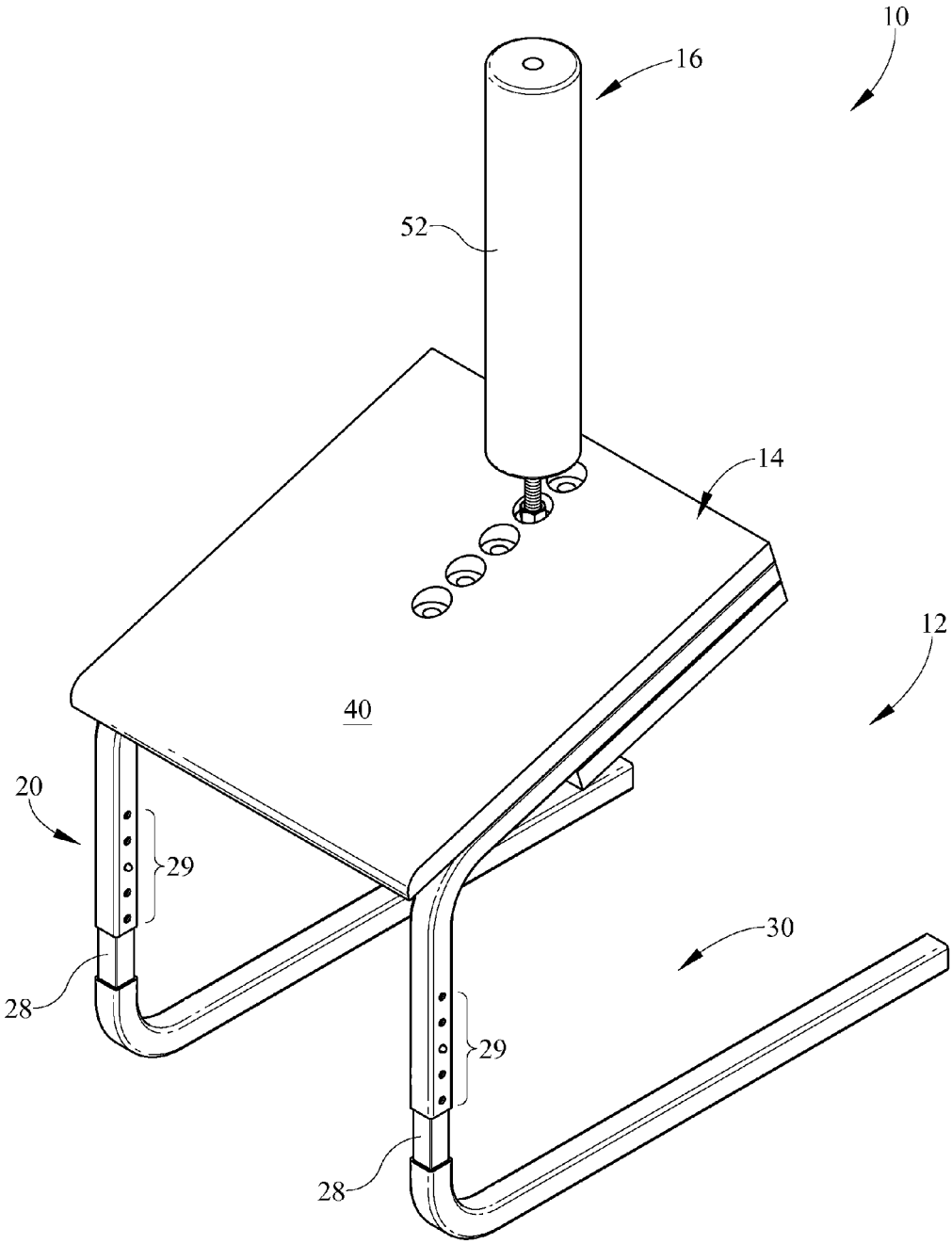
FIG. 1 is a perspective view of one embodiment of a seat assembly.

Referring now to FIG. 1, a seat assembly 10 is depicted in perspective view. The seat assembly 10 comprises a base portion 12, a seat portion 14 and a back support portion 16.

The base portion 12 in the exemplary embodiment of FIG. 1 provides vertical popliteal adjustment to compensate for users having varying leg length. The seat portion 14 comprises a plurality of adjustment apertures 42 (FIG. 2) which allow for movement of the back support 16 along the seat portion 14 to compensate for varying leg length. Accordingly, the seat assembly 10 may be adjusted or fitted to a user's specific build, in order to promote activation of postural fibers. To perform such, the back support portion 16 may be moved along a dimension between a front edge and rear edge of the seat portion 14.

Figure 2:
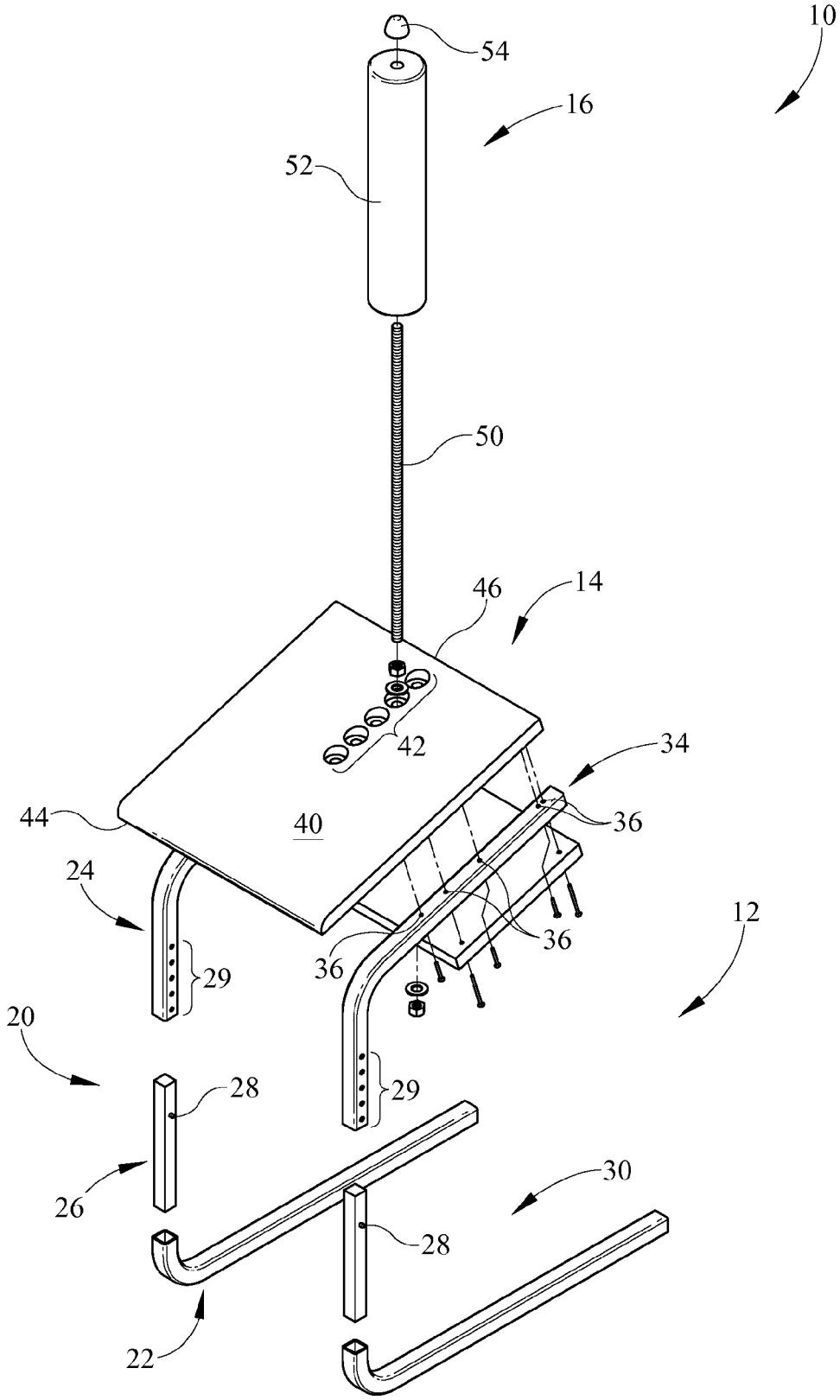
FIG. 2 is an exploded perspective view of the seat assembly of FIG. 1.

Referring now to FIG. 2, the seat assembly 10 is depicted in exploded perspective view. The seat assembly 10 comprises the base portion 12. The base portion 12 comprises a first leg 20 and a second leg 30 each having a lower portion 22 and an upper portion 24. The upper portion 24 includes a vertical segment and a seat support segment 34. The lower portion 22 includes a curved segment and a substantially horizontal support segment. The lower and upper portions 22, 24 are joined by a coupling 26 portion. However, the upper portion 24 or the lower portion 22 may be joined with the coupling portion 26 to form a single element. In the exemplary embodiment, the upper portion 24 and the lower portion 22 have a substantially square cross-section, however, alternative shapes may be utilized including circular or other structurally rigid cross-sectional shapes. The coupling 26 is of a slightly smaller perimeter size, so as to be received by both the lower portion 22 and the upper portion 24. The coupling portion 26 bottoms out near the curved area of the lower portion 22. Additionally, while the coupling 26 is depicted as having a perimeter small than the inside portion of the upper portion 24, as an alternative design, the invention may comprise a lower portion 22 having a square or other cross-sectional shape, which has an inside opening larger than that of the upper portion 24, so that the upper portion 24 fits within the coupling portion 26, or within the combined coupling and the lower portion. The upper end of the coupling 26 is received by the hollow upper portion 24. The coupling 26 includes a biased pin 28, which is received by one of a plurality of pin holes 29 located along the vertical length of the upper portion 24. As will be understood, the pin holes 29 and pin 28 positions could be reversed. As the coupling 26 slides into the upper portion 24, the pin 28 may be depressed until a suitable height is found for the user's leg length. At that location, the pin 28 will extend through one of the apertures 29 and lock the seat assembly 10 at the preselected height.

The upper portion 24 comprises a vertical segment, as previously described, and the seat support segment 34, which is disposed at an angle to the vertical segment. The seat support segment 34 has a cross-sectional shape matching that of the vertical segment of the upper portion 24. The seat supports segments 34 have an upper surface to receive the seat portion 14. Along an upper surface of the seat support segment 34 are a plurality of fastener apertures 36. The fastener apertures are utilized to connect the seat support segments 34 to the seat portion 14.

The seat portion 14 is fastened to the upper portion 24 using the fasteners indicated and extending through the fastening apertures 36. The seat portion 14 is depicted as having a square geometry, although alternative shapes may be utilized which are dimensioned to cooperate with the upper base portions 24. The seat portion 14 may be a rigid material, for example, may be formed of wood, plastic or metal to provide proprioceptive feedback. Similarly, the seat portion 14 may have a covering made of padding, cloth, vinyl, or other material (real/synthetic), which provides some limited resistance, as previously discussed. The seat support segments 34 are angled with respect to the vertical, so that the upper seat portion 14 is in a declined posture from a rear edge 46 to a front edge 44. The angle of decline of the seat portion 14 may range from about 100 degrees to about 112 degrees from a line extending upwardly from the rear edge of the seat portion 14. The angled seat portion 14 causes loading of the user's legs. The goal is a solid, firm, angled legs 20,30 wedge frame of the alternative embodiment which places the seat portion 14 within the preselected angular range angle. For the purpose of body awareness the more direct the contact between the firm frame and the user's body the better the information to the proprioceptors. A slight amount of padding over a solid firm frame does not diminish the effect of the chair substantially, and may be needed in certain populations, such as the elderly, diabetic, spinal cord injured, etc. However, completely soft, or moldable frames, such as completely foam wedges or air filled rubber wedges would likely be too soft and may not provide enough proprioceptive information to the user.

The seat portion 14 also comprises a surface 40 having at least one adjustment aperture 42. In the exemplary embodiment, five such apertures are depicted which receive the back support portion 16. However, various designs may be utilized to allow for adjustment of the back support between a front edge of a seat portion 44, and a rear edge of the seat portion 46. For example, rather than having five apertures, one or more elongate apertures may be used, which allow the back support portion 16 to slide into various positions.

The back support potion 16 comprises a rod 50 which is adjustably positioned in the seat portion 14. The rod 50 extends through one of the adjustment apertures 42 in the seat portion 14 depending upon the length of the user's legs. For example, taller users would have the rod 50 positioned closer to the rear edge 46, while shorter users would have the rod 50 positioned in the adjustment apertures 42 closer to the front edge 44 of the seat portion 14. The threaded rod 50 is positioned and locked into place by fasteners including nuts and washers on the upper and lower sides of the seat portion 14. The adjustment apertures 42 are countersunk so that the washers and nuts which fasten to a rod 50 are positioned at or beneath the surface of the seat portion 14.

The back support 16 also comprises a pad 52 extending over the rod 50. The pad 52 may be formed of a fibrous material or a foam. In the exemplary embodiment a swimming pool "noodle" is utilized having a hollow central portion which is disposed over the rod 50, however, this is merely exemplary as alternative pad designs may be utilized. For example, padding, cloth, vinyl, or other material (real/synthetic) may be used on the back portion 16, either separate or in addition to the pad 52. A cap 54 is positioned on the end of the rod 50 once the pad 52 is positioned thereon, so as to inhibit a user from being cut or scraped by the edge of the rod 50. The rod 50 and the pad 52 have a small width as compared to most chairs, so that the back support 16 may be positioned between the shoulder blades of the user. This back support 16 provides a prompt to users to urge the shoulders backward, so that the scapula are properly positioned posturally.

Figure 3:
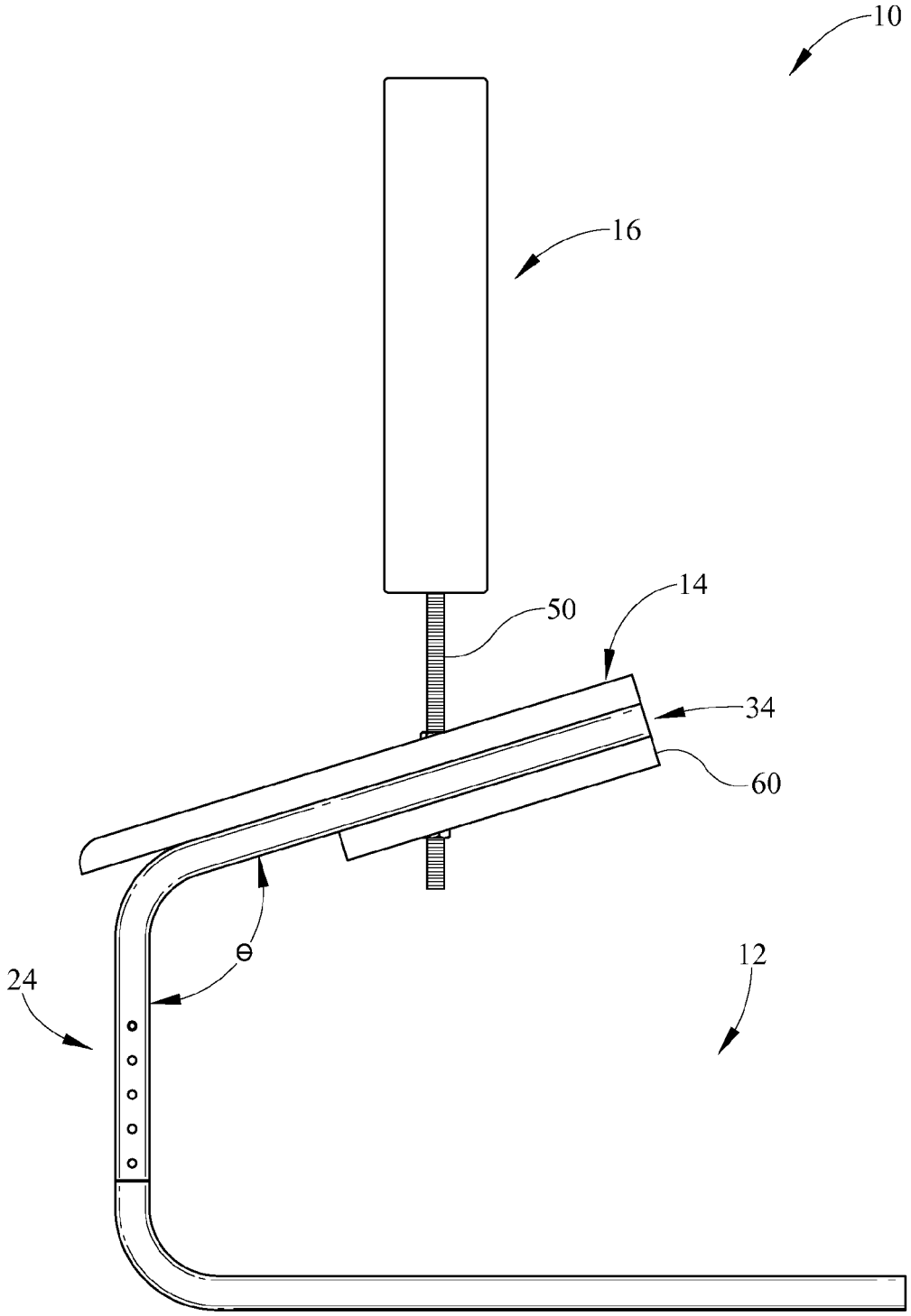
FIG. 3 is a side view of the seat assembly of FIG. 1.

Referring now to FIG. 3, a side view of the seat assembly 10 is depicted. The rod 50 is shown extending through the seat portion 14. Extending between the first and second legs 20, 30 (FIG. 2) beneath the seat portion 14, and opposite the upper segment 34 from the seat portion 14, is an opposed rod support structure 60. The rod 50 extends through the seat portion and through the rod support 60, and allows tightening of the rod 50 in two spaced locations. Additionally and as previously discussed, the rod 50 is tightened utilizing a first nut and a second nut. The seat portion 14 has fastening apertures which are counter sunk, so that the nuts are either completing beneath seat portion 14 and rod support 60, or are only slightly extending above the surface as depicted. The upper portion segment 34 is angled from the vertical portion of the upper leg 24 by an angle θ. The angle θ is in the range of about 100° to about 112°. According to one embodiment, the angle θ is about 107°. This provides an obtuse angle between the user's torso and legs, which is preferable as described further herein. Additionally, the rod support 60 may be integrally formed with the seat portion 14 rather than extending across the first and second legs 20,30.

Additionally, the rod 50 is depicted extending through the seat portion 14 and rod support portion 60. Although the seat portion 14 is disposed at an angle corresponding to the upper segment 34, the rod 50 is disposed vertically through the seat portion and rod support 60. By utilizing a threaded rod 50 and nuts for fastening, the back support 16 is adjustable in a vertical direction.

Figure 4:
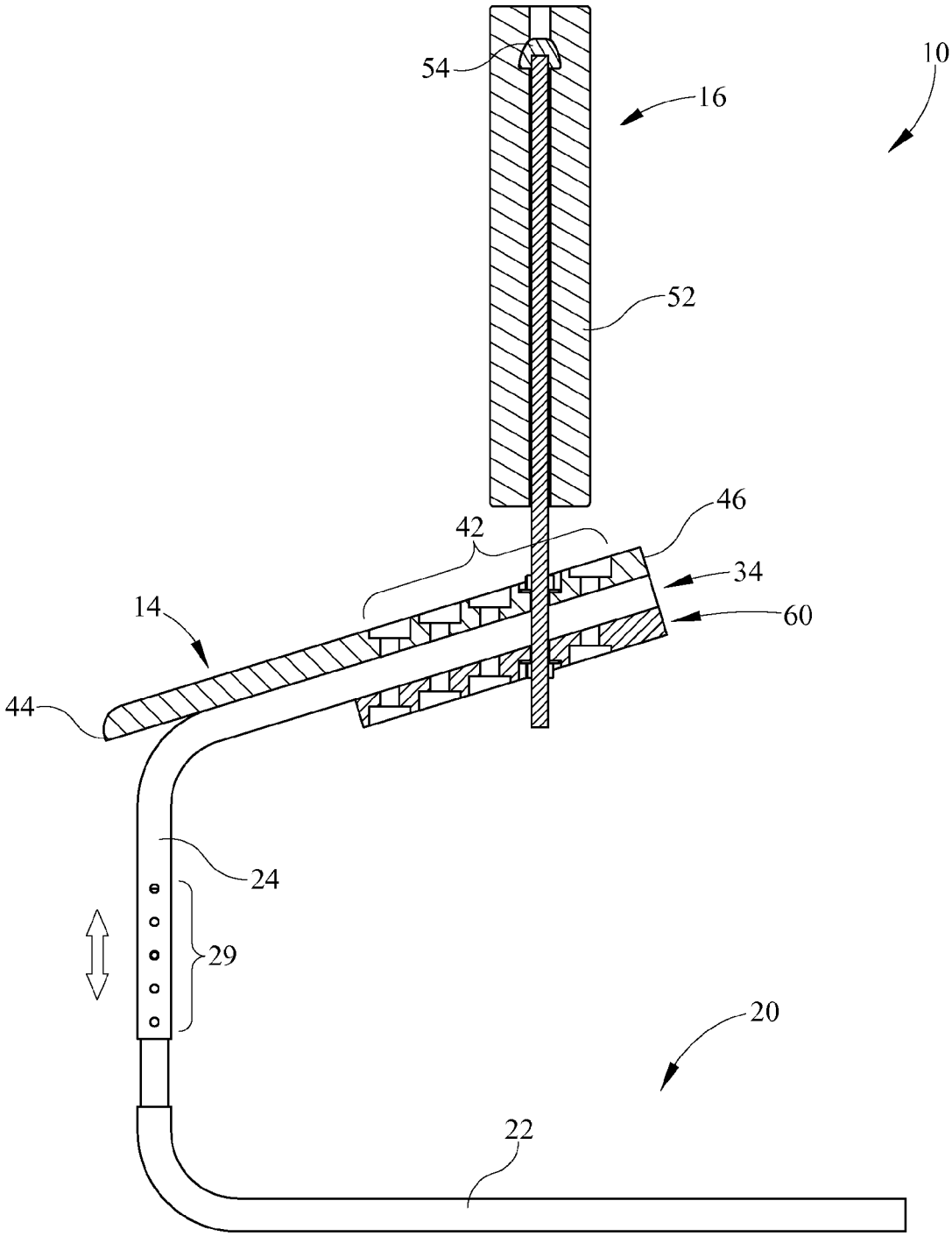
FIG. 4 is a cross sectional view of the seat assembly of FIG. 1.

Referring now to FIG. 4, a side-sectional view of the seat assembly 10 is depicted. The side sectional view depicts the adjustment apertures 42 in the seat portion 14 which allows for movement of the back support 16 between the front and rear edges 44,46 of the seat portion 14. Also, the upper leg 24 is shown in an adjustable position from the lower leg 22. The apertures 29 receive a pin 28 (FIG. 2) once the popliteal height of the seat assembly 10 is positioned properly.

Referring now to FIG. 5, a perspective view of an alternative embodiment of a seat assembly 110 is depicted. The seat assembly 110 is positioned in a chair 100 for use. The assembly 110 may be used with, for example, school children in chairs already in use at schools. The seat assembly 110 comprises a base portion 112, which is positioned on the seating area of the chair 100. Connected to the base portion 112, is a seat portion 114. The seat portion 114 is declined and a hard or rigid surface, as previously described. Extending upwardly through the seat portion is the back support 116.

Referring now to FIG. 6, an exploded perspective view is depicted of the seat assembly 110. The assembly comprises the base portion 112 which is pivotally connected to a seat portion 114. The base portion 112 is formed of a hard solid material, such as a wood material, molded plastic or metal. The base 112 is substantially rectangular or may be square or some other shape which will fit on a chair, such as shown in FIG. 7. The base portion 112 includes a lower surface and an upper surface wherein the lower surface may include a non-slip material such as a rubber-type material. A back support portion 116 extends substantially vertically through the seat portion 114. Above the upper surface of the base portion 112 is an adjustment structure 160. The adjustment structure 160 is movable toward or away from the front edge of the base portion 112 to adjust the angle of the seat portion 114. The adjustment structure 160 includes a pin 162 which extends from a lower surface of the adjustment structure 160. On the upper surface of the base portion 112 are a plurality of apertures having a diameter corresponding to the diameter of the pin 162. The apertures 164 allow movement of the adjustment structure 160, thereby changing the angle of the seat portion 114. Alternatively, the adjustment structure 160 may be positioned on a sliding assembly rather than a plurality of distinct apertures. Also depicted between the seat portion 114 and base portion 112 is a pivoting structure 170. The pivoting structure depicted may be a hinge, however alternative structures could be used such as a living hinge, joint or other pivot structures. The seat portion 114 may be adjusted through a range of angles from about 5° to about 30°, and more preferably 15-20 degrees.

The base portion 112 further comprises first and second straps 113. The straps 113 may include a ratchet, buckle or other fastening and adjustment structure which may be known to one skilled in the art. The straps 113 are utilized to tighten the seat assembly 110 against a chair 100 (FIG. 5).

As previously described, the seat portion provides a hard declined surface within which are located a plurality of back support adjustment apertures 142. These adjustment apertures 142 allow for various positions of the back support 116. Alternatively, the plurality of apertures may be a single aperture which is elongated to allow movement of the rod 150 of the back support 116. As a further alternative, the plurality of apertures 142 may be elongate with several aperture positions. The seat portion 114 is also substantially rectangular in shape, although various shapes may be utilized.

The back support 116 includes the rod 150 and a pad 152 which is positioned over the rod 150. A cap 154 is exposed above the pad 152 and placed over the top end of the rod 150. The back support 116, specifically the rod 150, is moveable through the plurality of fastening apertures 142 and the seat portion 114. Beneath the seat portion 114 is a rod support plate 156. The support plate 156 has a plurality of apertures 158 which receive the rod 150. Thus, the area supporting the back support portion 116 has a greater thickness than the seat portion 114 alone, which provides for improved stability of the rod 150 and strength in the back support portion 116. As an alternative embodiment, the rod support plate 156 may be integrally formed with the seat portion 114 in order to provide a thickened area of greater strength for connecting the rod 150. The rod 150 is preferably connected on an upper side of portion 114 and along the lower side of the rod support plate 156.

Referring now to FIG. 7, a side sectional view of the seat assembly 110 is depicted. The rod support plate 156 is depicted fastened against the lower surface of the seat portion 114. The rod 150 passes through the seat portion 114 and the plate 156. Each of the seat portion 114 and the plate 156 include apertures for positioning nuts to lock the back support 116 in place. As a result, the adjustment depth D may be varied from the front edge of the seat portion 114 to the back support portion 116 by moving the rod 150 into the adjustment apertures 142. As previously described, alternative apertures 142 may be utilized which allow the rod to move from front to rear or vice-versa within the seat portion 114.

Also, the use of a thread rod 150 and nuts allow for vertical adjustment of the back support 116. The side section view also depicts the fastening apertures 164 and the base portion 112 of the seat assembly 110. By moving the support structure 160 and pin 162 in to the different apertures 164, the angle of the seat portion 114 may be varied due to the hinged or pivoting connection of the base portion 112 and seat portion 114.

The seat assemblies 10, 110 provides various advantages for users, especially those who have physical maladies and those who may be mentally challenged which lends to the physical challenges. The seat assemblies 10, 110 improve lower back posture and inhibit rounding of the upper back and shoulders. In turn, this leads to improved attention to task and productivity.

Likewise, the seat assemblies of the exemplary embodiments provide a user with improved posture during extended times in the seated position. Proper posture during these extended times decreases back pain associated with being in a seated position with improper posture.

With reference now to FIGS. 9 and 10, the exemplary seat assembly 10 is shown with a skeletal structure in the seated position. The downward sloping seat portion 14 facilitates alignment of the pelvis and spine. Pelvic (hip) alignment is directly related to alignment of the sacrum (lower spine) through the sacroiliac (spine-hip) joint and subsequently to the entire spinal column. The pelvis is capable of tilting anteriorly (forward) and posteriorly (backward). When the pelvis tips backward beyond a certain point the lumbar spine (arch of back) is pulled out of the natural anterior convex curve into a flattened or even reversed curve. When the pelvis tips too far anteriorly the lumbar spine moves into an excessive anterior convex curve (lordosis). However a slight anterior tilt promotes a natural anterior convex curve and allows weight bearing on the ischial tuberosities (buttocks bones). The seating assemblies 10, 110 are designed to encourage about 105-120 degree thigh to torso angle, and more preferably about 110-115 degree thigh to torso angle, thereby facilitating a slight anterior tilt of the pelvis promoting proper alignment superiorly. This is in contrast to the most commonly used chairs, which encourage a posterior tilt of the pelvis, thereby forcing the spine superiorly out of proper alignment and hindering function. Optimal upper extremity functioning requires mobility upon a stable base of support. Alignment of the superior (upper) spine and other structures is a reflection of the alignment of the pelvis. The downward slope of this seat portion 14 enables the pelvis to have a slight anterior tilt and therefore encourages a natural curve superiorly of the spinal column.

Another contributing factor to posterior pelvic tilting is increased tightness of hamstrings, due to the location of the muscle attachment on the pelvis and the direction of muscle pull. The instant seat assembly 10, 110 encourages about 110-115 degree thigh to torso angle promoting a more open or obtuse angle of the trunk to torso thereby decreasing the strain or pull of the hamstrings on the pelvis into a posterior direction.

The seat assembly 10, 110 also causes activation of the postural motor muscles. A muscle contraction is a very complex multi-step process. It is important to understand for the purposes of sitting posture that the process of a muscle contraction is often oversimplified. The active involvement of the neuromotor system in a body at rest is often underestimated. During muscle contraction the myofilaments (protein fibers) within the muscle do not actually shorten. The thin protein fibers deep within the muscle actually further overlap the thick protein fibers, forming a cross-bridge. A muscle has the most optimal ability to contract when the muscle is in a resting posture (not over-lengthened and not over-shortened). There is a decrease in the contractile ability and strength of contraction when a muscle is in an over-lengthened or over-shortened position. By appropriately aligning the pelvis and spine the seat assembly 10, 110 enables postural motor units to easily fire. Also, the neuromotor systems efficiency is often underestimated. A body first recruits muscle fibers with the greatest endurance, the slow twitch postural fibers. If a need for increased velocity or strength occurs the body will gradually recruit faster motor units. Optimal recruitment of the postural muscle fibers occurs when muscles are in a resting position. This eliminates short-lived bursts into an upright position using fast twitch fibers when needs arise. By eliminating the over-lengthening of the trunk extension muscles and the over-shortening of the abdominal muscles, the seat assembly 10, 110 system allows the body to remain in an efficient position of active rest thereby maximizing energy efficiency and eliminating the need to rely on the skeletal system to remain upright.

Proprioception, simply explained, is the perception of body position in relation to space, including the relationship of body segments in relation to other body segments. Proprioceptors are the sensory receptors within and around the joints and muscles that respond to changes in position, length, and tension, such as muscle spindles, Golgi tendon organisms, and skin mechanoreceptors. Due to the locations within the central nervous system where proprioception is processed, this sense is thought to play a role in arousal, motor learning, motor planning, and postural control. The proprioceptive system also is closely connected to the visual and vestibular (movement) sensory systems. Proprioception has been used in sensory integrative therapy as a tool for overall body organization, in order to modulate arousal level and sensations. Active stretch of the muscle occurs when the muscle is stretched against resistance, such as in weight-bearing activities. Because sitting is actually an active position, muscles are continuously working against gravity and the surface area in order to maintain an upright posture. The more resistance from the surface the more the proprioceptors within the skin and muscles are activated. Specifically, the slowly adapting cutaneous mechanoreceptors (accounting for about 50% of the tactile receptors) maintain a sustained response to enduring stimulus. The seating assembly 10, 110 uses a firm and large seat surface in order to maximize the weight-bearing area and the opposing force, thereby increasing the number of mechanoreceptors (sensory receptors) that are activated and thus increasing proprioception. The increased proprioception results in a proposed greater ability to engage in activities, attend to task, and maintain postural control. The stable surface enables a body to be more dynamic and active off of the surface by providing a firm resistance to work from and actively engage motor units.

The seat assembly 10, 110 includes a back support 16, 116 which allows improved postural positioning of the scapula. The scapula (shoulder blade) is an underestimated contributor to overall upper extremity function, which is able to move in six directions within the frontal and horizontal planes of motion. The scapula is connected to the humerus (upper arm bone) through the glenohumeral joint. Much like the pelvis and spine, alignment of one impacts alignment of the other and therefore impacts efficient functioning. In order for the distal upper extremity (elbow, wrist, and hand) to perform mobile and coordinated tasks efficiently the proximal extremity (the scapula) must be stable. Scapular stabilization requires highly coordinated isometric (maintained length) contractions of unrestricted muscles. Therefore proximal restrictions, such as wide seat backs, reduce distal function. High and/or wide seat backs often hinder or restrict the range of motion of the scapula and may contribute to increased and excessive thoracic (upper back) rounding. Patients with thoracic outlet syndrome often present a head forward posture with scapular abduction and shoulder internal rotation. The narrow back support portion 16 of the seat assembly 10 does not pressure or restrict scapular motion thereby allowing free and coordinated movement of the extremities.

Facilitation of postural motor unit recruitment through proper alignment of the pelvis and spine, as well as through a slight load through the lower extremities into the floor surface increases proprioceptive information. Balance of a body in a static position requires continuous minute adjustments of muscles in order to maintain the center of gravity over the base of support. A body must extend body segments against the surface in order to overcome the force of gravity. When a body is positioned on a slight downward slope toward the front, the center of gravity line is moved forward and therefore one must adjust in a slight posterior direction. This seating system creates a need to exert a slight extension force into the seat and floor surface. This requires centrally generated activation of the postural motor units and subsequently greater proprioceptive information. Once again contributing to improved attention to task, engagement in activity, and postural control.

Those skilled in the art will appreciate that the seat assembly of the present exemplary embodiments may be used in conjunction with various types of chairs to improve posture of the user. Additionally, various structures and components may be incorporated to the various seat assemblies taught herein to provide additional functionality. For example, the non-exhaustive list may include attachments for exercise or therapeutic equipment such as resistance bands, resistance tubes, pulleys, and the like. The seat assemblies may also include sensory, relaxation, or therapeutic modifications such as vibration, massage, or the like. The seat assemblies may also include resting devices or attachments for extremities such as arm rests and foot rests. The seat assemblies may have compartments for storage, audio/video capability, wheels, sliding devices, and/or a motor to make device mobile. The seat assemblies may also have harnesses or safety devices, positioning pads such as lumbar pads, neck rest, or the like. Finally, the seat assemblies may have devices attached for increased work such as lighting, desk top, computer pad, computer hardware, connections for communication devices, such as fax, telephone, internet and the like.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

What is claimed is:

1. A seat assembly for improving posture of a user, comprising:

a base portion;

a substantially rigid seat portion to provide proprioceptive feedback to said user, said seat portion supported by said base portion in a position angled downwardly from rear to front;

a substantially vertical back support extending upwardly in a rear area of said seat portion, said substantially vertical back portion supported by at least one of said seat portion and said base portion;

said seat portion comprising at least one aperture substantially centrally positioned between opposite lateral sides of said seat portion and defining multiple back support locations between said rear and said front of said seat portion;

a pad positioned on said back support, said back support having a lower end passing through said at least one aperture and selectively positionable in one of said multiple back support locations for varying seat depth and said pad having a convex surface extending toward a user's back and convex about a vertical axis for engaging a user's thoracic spine area.

2. The assembly of claim 1, said seat portion being adjustable through a plurality of angles wherein said seat portion is declined.

3. The assembly of claim 2 wherein, said seat portion is pivotally connected to said base portion.

4. The assembly of claim 3 further comprising an angle adjustment structure.

5. The assembly of claim 4, said angle adjustment structure being movable through a plurality of positions on said base portion.

6. The assembly of claim 1, said back support being a rod extending through said seat portion.

7. The assembly of claim 6, said seat portion further comprising a plurality of adjustment apertures, said rod being adjustable through said plurality of adjustment apertures.

8. The assembly of claim 1 wherein said base portion comprises at least one leg.

9. The assembly of claim 8, said seat portion positioned on said base portion.

10. The assembly of claim 9, said back support extending upwardly from said base portion above a rear edge of said seat portion.

11. The seat assembly of claim 8, said base portion having an adjustable popliteal height.

12. The seat assembly of claim 11, an adjustable portion of said base portion at an angle of about 107 degrees from said seat portion.

13. The seat assembly of claim 8, wherein said back support is at an angle of between about 105-110 degrees from said seat portion.

14. The seat assembly of claim 1, said back support being adjustable through a vertical distance.

15. The seat assembly of claim 1, said seat portion having a rigid seat surface.

16. A posture improving seat assembly, comprising:

a substantially rigid declined seat portion having an upper rear edge and a lower front edge, said seat portion providing proprioceptive feedback to a user;

a base portion, said declined seat portion connected to and supported by said base portion wherein a thigh to shin angle of a user is greater than ninety degrees is created and a thigh to spine angle of said user is greater than ninety degrees when said user is seated on said seat portion;

said seat portion comprising at least one aperture positioned centrally between opposite lateral sides of said seat portion and defining a plurality of back support mounting positions between said upper rear edge and said lower front edge;

a substantially vertical back support having a first lower end received by said at least one aperture and a second end providing a thoracic prompt, said back support adjustable to move through said plurality of back support mounting positions and to be supported in a substantially vertical position by at least one of said base portion and said seat portion; and, said back support being vertically adjustable relative to said seat portion, said back support being convex about a vertical axis and convex in a direction toward a user's thoracic spine area, said back support and pad allowing improved postural positioning of the user's shoulder blades without inhibiting distal function of the user's shoulders.

17. The seat assembly of claim 16, said back support having a width which fits between a user's shoulder blades.

18. The seat assembly of claim 16, said back support further comprising a foam padding.

19. The seat assembly of claim 16 further comprising a hinge connecting said seat portion to said base portion.

20. The seat assembly of claim 19 further comprising at least one adjustment structure within said declined seat portion.

21. The seat assembly of claim 20, said at least one adjustment structure being at least one aperture.

22. The seat assembly of claim 16 further comprising an adjustable structure in said base portion.

23. The seat assembly of claim 22, said base portion comprising first and second legs each having an upper leg portion and a lower leg portion.

24. The seat assembly of claim 1, said back support being centrally disposed between lateral edges of said substantially rigid seat portion.

25. The seat portion of claim 1, said back support having a width which is less than a height.

26. The seat portion of claim 1, said back support being capable of fitting between shoulder blades of said user.

27. The seat portion of claim 1 wherein said seat portion and said back support define an obtuse angle therebetween.

28. A seat assembly, comprising:

a base portion;

a substantially rigid seat portion to provide proprioceptive feedback to a user, said rigid seat portion being declined from an upper rear edge to a lower front edge;

a substantially vertical back support extending upwardly relative to said seat portion;

said seat portion comprising at least one aperture centrally located between opposite lateral sides of said seat portion and defining a plurality of back support mounting positions between said upper rear edge and said lower front edge;

said back support including a pad, said back support having a lower end removably received in said at least one aperture such that said back support may be moved to various of said plurality of back support mounting positions and supported substantially vertically by at least one of said base portion and said seat portion; and, said pad having an engagement surface that is convex in a direction toward said user, said engagement surface being convex about a vertical axis to prompt improved postural positioning of the user's shoulder blades.

* * * * *